US011300089B2

(12) United States Patent
Rottengruber et al.

(10) Patent No.: US 11,300,089 B2
(45) Date of Patent: Apr. 12, 2022

(54) INJECTOR AND METHOD FOR INJECTING FUEL AND AN ADDITIONAL FLUID

(71) Applicant: OTTO-VON-GUERICKE-UNIVERSITAET MAGDEBURG, Magdeburg (DE)

(72) Inventors: Herrmann Rottengruber, Unterschleissheim (DE); Johannes Oder, Magdeburg (DE); Thilo Wagner, Magdeburg (DE)

(73) Assignee: OTTO-VON-GUERICKE-UNIVERSITAET MAGDEBURG, Magdeburg (DE)

( * ) Notice: Subject to any disclaimer, the term of this patent is extended or adjusted under 35 U.S.C. 154(b) by 0 days.

(21) Appl. No.: 17/275,097

(22) PCT Filed: Sep. 21, 2019

(86) PCT No.: PCT/DE2019/000247

§ 371 (c)(1),
(2) Date: Mar. 10, 2021

(87) PCT Pub. No.: WO2020/064038

PCT Pub. Date: Apr. 2, 2020

(65) Prior Publication Data

US 2021/0254589 A1 Aug. 19, 2021

(30) Foreign Application Priority Data

Sep. 25, 2018 (DE) ..... 102018007614.9

(51) Int. Cl.
*F02M 61/10* (2006.01)
*F02M 63/00* (2006.01)
(Continued)

(52) U.S. Cl.
CPC ..... *F02M 63/0064* (2013.01); *F02M 25/03* (2013.01); *F02M 51/0617* (2013.01); *F02M 61/10* (2013.01); *F02M 63/0017* (2013.01)

(58) Field of Classification Search
CPC ..... F02M 63/0064; F02M 63/0017; F02M 25/03; F02M 51/0617; F02M 61/10;
(Continued)

(56) References Cited

U.S. PATENT DOCUMENTS 5,762,033 A 6/1998 Rembold et al.
6,092,514 A 7/2000 Ruoff et al.
(Continued)

FOREIGN PATENT DOCUMENTS

DE 19625698 A1 1/1996
DE 19746489 A1 4/1999
(Continued)

OTHER PUBLICATIONS

Rauscher, M. et al. "Einfluss der Geschichten Einspritzung auf die Stickoxydemission", MTZ—Motortechnische Zeitschrift, Springer, vol. 57, No. 2, Feb. 1, 1996, pp. 124-130. (with English Abstract on p. 125)).
(Continued)

*Primary Examiner* — Hai H Huynh
(74) *Attorney, Agent, or Firm* — Cohen & Hildebrand, PLLC

(57) ABSTRACT

An injector (1) for injecting fuel and an additional fluid, is provided in that the injector (1) is designed for optimal space-saving yet exhibiting a simple construction. This construction results in a precise injection of a fuel and an additional fluid into a combustion chamber of an internal combustion engine. The arrangement has two solenoid valves, the first valve (2) and the second valve (3). The second solenoid valve (3) has a second nozzle needle (9) which is arranged in the injector (1), and the first nozzle needle (7) of the first solenoid valve (2) and the second nozzle needle (9) of the second solenoid valve (3) are arranged one behind the other on a longitudinal axis (10) of
(Continued)

the injector (1). Further, the nozzle needles (7, 9) can be controlled independently of one another.

8 Claims, 3 Drawing Sheets

(51) Int. Cl.
*F02M 25/03* (2006.01)
*F02M 51/06* (2006.01)

(58) Field of Classification Search
CPC ..... F02M 61/168; F02M 43/04; F02D 19/12; F02D 41/0025; F02B 47/02; F02B 17/005
USPC ..... 123/490, 25 C, 525, 431; 251/129.15
See application file for complete search history.

(56) References Cited

U.S. PATENT DOCUMENTS 6,273,032 B1 8/2001 Ruoff et al.
9,303,610 B2 * 4/2016 Jay ..... F02D 19/105
2008/0121215 A1 5/2008 Frasch et al.
2013/0098333 A1 * 4/2013 Kim ..... F02D 19/0694 123/445
2014/0373806 A1 * 12/2014 Hou ..... F02M 26/19 123/294
2015/0267659 A1 9/2015 Jaegle et al.
2016/0010610 A1 1/2016 Fujino et al.
2016/0123286 A1 * 5/2016 Hou ..... F02M 45/086 123/299
2016/0237974 A1 8/2016 Pendray

FOREIGN PATENT DOCUMENTS

DE 19747268 A1 4/1999
DE 102005004327 A1 8/2006
DE 102014205454 A1 9/2015
DE 102017201581 A1 8/2018
JP 2009228609 A 10/2009

OTHER PUBLICATIONS

International Search Report of WO2020/064038 (PCT/DE2019/000247), dated Feb. 4, 2020.

* cited by examiner

INJECTOR AND METHOD FOR INJECTING FUEL AND AN ADDITIONAL FLUID

This is an application filed under 35 USC § 371 of PCT/DE2019/000247, filed on Sep. 21, 2019, claiming priority to DE 10 2018 007614.9, filed on Sep. 25, 2018, each of which is herein incorporated by reference in its entirety.

BACKGROUND OF THE INVENTION

(1) Field of the Invention

The invention relates to an injector for injecting fuel and an additional fluid into a combustion chamber of an internal combustion engine, wherein the injector has a first solenoid valve with a first nozzle needle.

The invention also relates to a method for injecting fuel and an additional fluid into a combustion chamber of an internal combustion engine, wherein a first solenoid valve with a first nozzle needle is provided for injecting a fluid or a mixture into the combustion chamber.

The invention also relates to a use of the injector for producing an insulating vapor layer in a combustion chamber of an internal combustion engine.

Internal combustion engines or internal combustion engines are exposed to ever greater thermal loads due to ever higher specific powers.

(2) Description of Related Art

It is known that a so-called full load enrichment is carried out in internal combustion engines in operating states with high load, for example when producing the maximum engine power or the maximum torque. In this case, more fuel is added to the combustion air than can be completely burned in the combustion chamber of the internal combustion engine with the amount of oxygen present in the air.

This full-load enrichment is used, for example, to protect components during full-load operation of an internal combustion engine. The additional injected fuel increases the heat capacity of the fuel-air mixture formed in the combustion chamber. As a result, the temperature in the combustion chamber of the internal combustion engine drops, thus protecting the individual components or assemblies of the internal combustion engine.

The additional fuel injected for this purpose, however, disadvantageously affects the fuel consumption and the emissions from the internal combustion engine. Since full load enrichment, for example for full load operation, has a negative effect on the emission values to be complied with, developers are attempting to find other measures for lowering the temperature in the combustion chamber of the internal combustion engine.

As one of the measures suitable for this purpose, additional fluids, such as water, may be introduced or injected into the combustion chamber of an internal combustion engine. Such injections of additional fluids or the injection of water is already known in the art.

In this context, current developments are also known wherein water is injected into an intake manifold of an internal combustion engine. The water-air mixture thus formed is then sucked in by the piston and thus reaches the combustion chamber of the internal combustion engine.

Such an intake manifold injection has certain disadvantages with regard to what is commonly referred to as charge stratification.

The term charge stratification refers to the locally different distribution or composition of the fuel-air mixture in the combustion chamber of the internal combustion engine. With this method, which is also referred to as stratified charge, for example, an ignitable fuel-air mixture may be located in one area of a spark plug, while the remaining volume of the combustion chamber is filled with a lean mixture which is difficult to ignite.

On the one hand, the water is more or less homogeneously distributed in the air and thus also in the combustion chamber of the cylinder. On the other hand, precise metering of the amount of water from stroke to stroke of the internal combustion engine is quite difficult.

Injectors or injection valves which, in different operating states of an internal combustion engine, precisely inject the fuel quantity calculated, for example, by a control unit are in the art.

Such injectors are, for example, actuated electromagnetically. A control unit calculates and controls the electrical impulses for opening and closing the injectors on the basis of current sensor data of the operating state of the internal combustion engine as well as stored algorithms. Such injectors have a valve body in which a so-called solenoid valve, composed of a magnetic winding or magnetic coil, a guide for a nozzle needle and a nozzle needle are arranged. When a voltage is applied to the magnet winding, the nozzle needle lifts off its valve seat and exposes a precision bore. In this case, the fuel, which is for example under pressure, can be injected through the precision bore into the combustion chamber of an internal combustion engine, where it is distributed in the combustion chamber depending on the geometry of the precision bore. Without an applied voltage, the nozzle needle is pressed onto the valve seat by a spring and closes the precision bore. No fuel is therefore injected.

When the injector is open, the flow rate of the fuel is precisely defined by the precision bore and the current pressure conditions and can therefore be controlled very precisely by influencing the opening time of the injector with the control unit. Such injectors can be switched very quickly and precisely and thus enable precise injection of fuels or additional fluids.

It is known in the art to arrange such injectors or injection valves, also referred to as injection nozzles, both in the intake tract and directly in the combustion chamber of the internal combustion engine.

Various arrangements and methods for injecting fuels or fuels and additional fluids by using injectors or injection valves are known in the art.

DE 196 25 698 A1 discloses an injection device for the combined injection of fuel and an additional fluid. In particular, such an additional fluid is water.

The object is to provide an injection device which eliminates the known complexity associated with an additional cam, and metering of the fuel injection quantity can be controlled much more universally and as a function of various parameters. In addition, metering of the additional fluid should also be controlled with a solenoid valve while taking several parameters into account.

This object is attained by providing in such an injection device having an injection valve or injector a high-pressure feed pump as the high-pressure fuel source, which supplies a high-pressure reservoir in which a specified pressure is set and from which the fuel intended for fuel injection is removed in a controlled manner by the control valve assigned to each injection valve.

As particularly advantageous, the delivery of the additional fluid no longer depends on the work cycles of an individual pump piston as in the prior art, but can be set ahead of time in the fuel injection valve for the required point in time by way of the electrically controlled valve and the always available high fuel pressure.

It is also disclosed that a high-pressure reservoir is provided which hence advantageously provides a predetermined injection pressure at all times. In addition, the metering device, which has an electromagnetic valve, can be used to carry out an injection with a precisely controlled quantity and injection time.

DE 197 46 489 A1 describes a fuel injection system for an internal combustion engine, that is able to overcome the disadvantages of conventional fuel injection systems which require each individual injector to have a complex and relatively expensive 3/2-way valve for metering the additional fluid as well as an additional 3/2-way valve for controlling the diesel injection quantity.

For this purpose, a first 2/2-way valve is arranged in the injection line between the common rail pressure accumulator and the pressure chamber and a second 2/2-way valve is provided, whose inlet is connected to the injection line via a supply line at a point between the first 2/2-way valve and the pressure chamber and whose outlet is connected to the fuel low-pressure side via a discharge line.

DE 197 47 268 A1 discloses a two-fluid nozzle for injecting fuel and an additional fluid into a combustion chamber of an internal combustion engine.

Disadvantages of the prior art that have to be overcome include that known two-fluid nozzles or injectors can cause intermixing of fuel and an additional fluid, i.e. usually diesel and water, which can take place in the building sections before and after the injection nozzles. In addition, the injection can in principle always only take place sequentially, meaning that, for example, fuel and additional fluid cannot be injected simultaneously.

These disadvantages can be overcome with a nozzle body having at least one inlet bore for supplying high-pressure fuel into the two-fluid nozzle and nozzle bores for injecting the fuel from the two-fluid nozzle into the combustion chamber, with a jacket preferably made of metal placed around the nozzle body, with the jacket enclosing at least one cavity adjacent to the outside of the nozzle body, in particular extending around the nozzle body for receiving additional fluid, and wherein a supply line for supplying the pressurized additional fluid into the cavity and one or more injection nozzles for injecting additional fluid from the cavity into the combustion chamber are provided.

This prevents fuel being mixed with an additional fluid before the actual injection. The two fluids can only combine in the combustion chamber of the internal combustion engine equipped with the two-fluid nozzle according to the invention.

Disadvantageously, for the injection of a fuel and an additional fluid, the prior art often requires two injectors, which may also be combined to form a structural unit. In addition, the construction and control of such injectors are sometimes very complex. The mixture formation in the combustion chamber of the internal combustion engine can also only be controlled inadequately.

There is therefore a need for an improved, robust injector which can be manufactured inexpensively and which overcomes the disadvantages of the prior art.

BRIEF SUMMARY OF THE INVENTION

The object of the invention is therefore to provide an injector for injecting fuel and an additional fluid, which has a space-saving, simple structure and which enables a precise injection of a fuel and an additional fluid into the combustion chamber of an internal combustion engine.

According to the invention, the injector according to the invention, in contrast to conventional electromagnetically operating injectors, is not equipped with a single solenoid valve, but has two solenoid valves. A first solenoid valve is hereby provided for injecting or metering an additional fluid, for example water, whereas a second magnetic valve is provided for injecting or metering a fuel. The first and the second solenoid valve each have at least the components solenoid, a guide for a nozzle needle and a nozzle needle. The injector according to the invention thus contains two fluid paths that can be controlled independently of one another.

The injector may in a region of its longitudinal axis have a first connection for supplying an additional fluid.

Furthermore, the injector may be designed with a second connection for supplying a fuel in a lateral region of the injector. This second connection may be attached, for example, in a central area of the outer wall of the injector, wherein the second connection may be oriented at an angle with respect to the longitudinal axis. Such an angle may be in a range between 15° and 75° with respect to the longitudinal axis of the injector, preferably at an angle of 45° with respect to the longitudinal axis of the injector.

A first nozzle needle, through which an additional fluid, such as water, can flow, may be opened by activating the first magnetic coil of the first magnetic valve. In absence of this electrical control, as is known in the art, the for example conical tip of the first nozzle needle is pressed by a first spring against a likewise conically terminated water chamber, which is connected to the first connection, and thus closed. This first nozzle needle is aligned along a longitudinal axis of the injector.

A second nozzle needle of a second solenoid valve may also be arranged on and aligned with the longitudinal axis of the injector, with the second nozzle needle being placed in the injector between the first nozzle needle and the combustion chamber.

The second nozzle needle may also have a longitudinal bore arranged, for example, at the center of the longitudinal axis, through which the additional fluid exiting the first solenoid valve, such as water, can flow and thus enter the combustion chamber of the internal combustion engine. In this way, the first solenoid valve can, for example, inject a metered quantity of an additional fluid, such as water, into the combustion chamber, independently of the operation of the second solenoid valve.

Fuel may also flow via the second connection into the fuel chamber of the injector, which is closed by the second nozzle needle. Such chambers for storing fuel or an additional fluid can advantageously compensate for pressure fluctuations.

Activating the second solenoid of the second solenoid valve opens the second nozzle needle, allowing fuel to be injected from the fuel chamber of the injector through the nozzle at the tip of the second nozzle needle into the combustion chamber of the internal combustion engine.

Without this electrical control, the for example conical tip of the second nozzle needle of the second solenoid valve is pressed by a second spring against a likewise conically terminated fuel outlet nozzle of the injector and is hence closed.

The first nozzle needle may have to move away from the combustion chamber in order to open the opening for injecting an additional fluid, whereas the second nozzle needle may have to move towards the combustion chamber in order to open the opening for injecting fuel into the combustion chamber.

A housing of the injector may also be constructed in three parts and joined together and secured in a mechanically stable manner by a first and a second union nut.

A positioning bolt ensures that the fuel bores in the lower and middle housing are axially aligned with one another.

As is known in the art, the first and the second spring cause a restoring force, which pushes the first and the second nozzle needle back into their respective starting position after the magnetic forces of the first and the second magnetic coil have been removed. Also provided is a stuffing box which supports the first spring in order to realize its operation, since this first spring is arranged in an inflow channel between the first nozzle needle and the first connection.

The lower, second nozzle needle may also be constructed from several parts in order to ensure easy assembly of the injector.

For example, the second nozzle needle may have a thread onto which an anchor can be screwed. The position of this anchor can be secured, for example, with a lock nut or an alternative fastening element.

With the injector according to the invention, a fuel and an additional fluid, such as water, can be injected independently of one another. A control unit and known systems for supplying a fuel or an additional fluid can be provided to control the injector. As is customary, the fuel and the additional fluid may be supplied to the injector under pressure.

The injector according to the invention may advantageously also be used to produce a locally differing composition of the fuel-air mixture, for example a charge stratification, in the combustion chamber of the internal combustion engine.

In this case, in the early intake phase, a water injection performed by the first solenoid valve precedes the fuel injection performed by the second solenoid valve.

The evaporated injected water can form an insulating vapor layer which surrounds or envelops the subsequently injected fuel and thus the fuel-air mixture. At the time of the combustion of the fuel-air mixture in the combustion chamber of the internal combustion engine, the insulating vapor layer forms an insulating layer in relation to the cylinder wall and the piston. This reduces in the wall heat losses via the cylinder walls.

A required amount of fuel may also be introduced into the combustion chamber by way of a plurality of injections within an intake phase of the internal combustion engine.

Several advantages of the present invention are listed below:

- Reduction of the wall heat losses by introducing an insulating vapor layer in the combustion chamber, which at least partially envelops the fuel-air mixture.
- Better filling of the combustion chamber through charge cooling.
- Raising the effective compression ratio by introducing water.
- Potentially more energy in the exhaust gas for energy recovery.
- A lower peak temperature can cause a shift towards the optimum position of fractional mass burn (e.g. crank angle to achieve 50% mass burn) of approx. 8° crank angle after the top dead center.
- Charge dynamics optimization through the introduction of kinetic energy (de-throttling).

The previously discussed features and advantages of this invention can be better understood and evaluated after carefully studying the following detailed description of the preferred, non-limiting example embodiments of the invention in conjunction with the accompanying drawings, which show in:

BRIEF DESCRIPTION OF THE DRAWINGS

FIG. 1 shows an injector 1 according to the invention for injecting fuel and an additional fluid. Water is described below as an example of such an additional fluid.

DETAILED DESCRIPTION OF THE INVENTION

Figure 1:
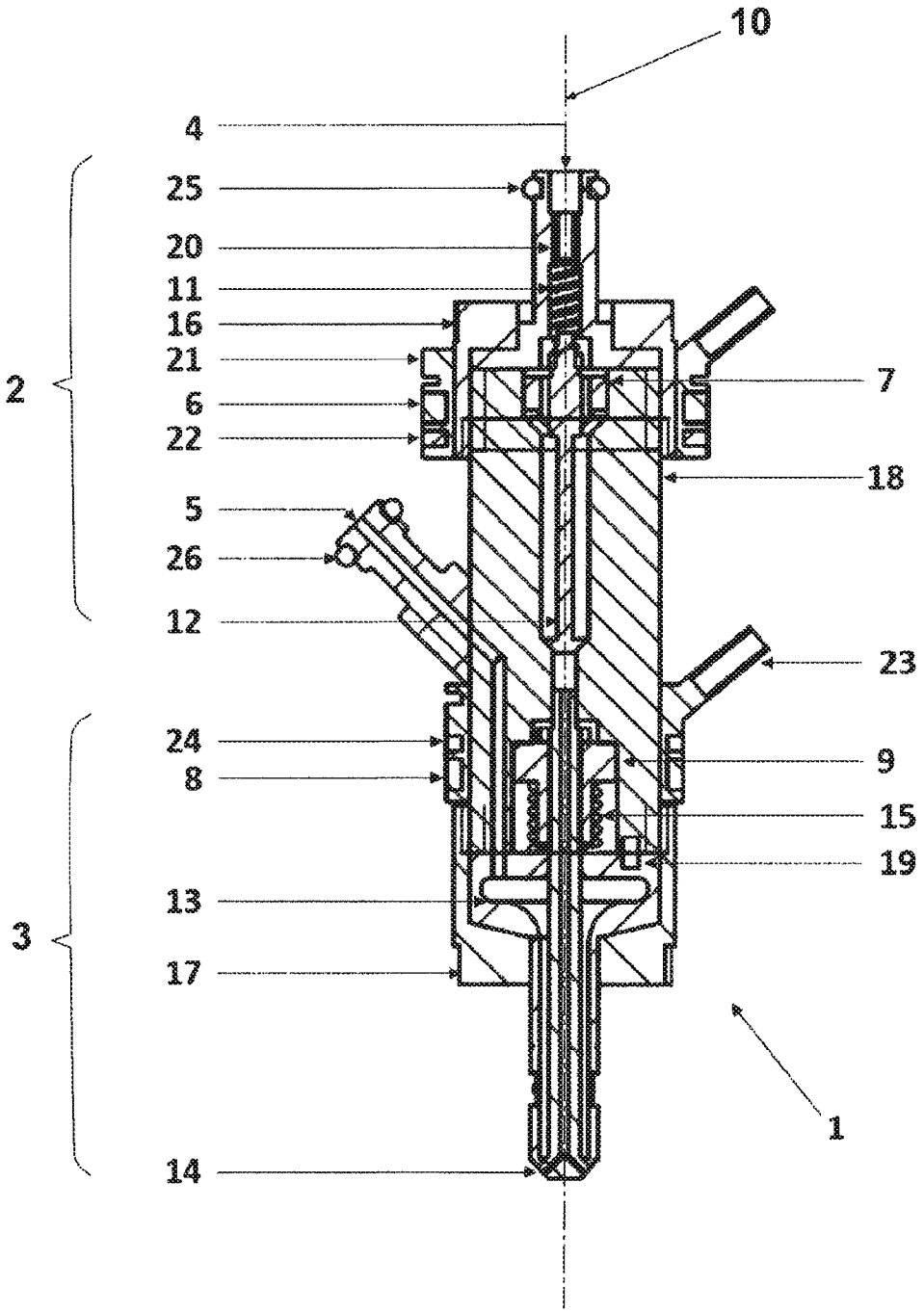
FIG. 1: an injector according to the invention for injecting fuel and an additional fluid.

According to the invention, the injector 1 according to the invention includes a first solenoid valve 2 and a second solenoid valve 3.

The first solenoid valve 2 is used to inject or meter the additional fluid water, which is supplied to the injector 1 via the first connection 4. The second solenoid valve 3 is provided for injecting or metering a fuel which is supplied to the injector 1 via a second connection 5. Both the fuel and the additional fluid can be supplied to the injector 1 with a corresponding applied pressure.

The first solenoid valve 2 has a first solenoid 6 and a first nozzle needle 7, with the first nozzle needle 7 being guided and supported in a corresponding guide within the injector 1.

The second solenoid valve 3 has a second solenoid 8 and a second nozzle needle 9, wherein the second nozzle needle 9 is also guided and supported in a corresponding guide within the injector 1.

The injector 1 according to the invention hence has two fluid paths that can be controlled independently of one another. Thus, with the injector 1, both a fuel and an additional fluid water can be appropriately metered independently of one another and introduced or injected into a combustion chamber of an internal combustion engine in a timed manner.

The first connection 4 for supplying an additional fluid is arranged, for example, in a region of the longitudinal axis 10 of the injector 1. This may be the end of the injector which faces away from the combustion chamber (not shown), when the injector 1 is in operation.

The injector 1 is designed with a second connection 5 for supplying a fuel in a lateral region of the injector 1. This second connection 5 can for example be attached in a central area of the outer wall of the injector 1, wherein the second connection 5 may be oriented at an angle with respect to the longitudinal axis. An exemplary arrangement of the second connection 5 is shown in FIG. 1.

Such an angle can be in the range between 15° and 75° with respect to the longitudinal axis 10 of the injector 1, preferably at an angle of 45° with respect to the longitudinal axis 10 of the injector 1.

The first nozzle needle 7, through which the additional fluid water flows, can be opened by activating the first magnetic coil 6 of the first magnetic valve 2. Without this electrical control, the for example conical tip of the first nozzle needle 7 is pressed by a first spring 11 against a likewise conically terminated water chamber 12 that is connected to the first connection 4 and thus closed. This first nozzle needle 7 is aligned along a longitudinal axis 10 of the injector.

The second nozzle needle 9 of the second solenoid valve 3 is also aligned on the longitudinal axis 10 of the injector 1, with the second nozzle needle 9 being arranged in the injector 1 in the region of the longitudinal axis 10 between the first nozzle needle 7 and the combustion chamber.

The second nozzle needle 9 has a longitudinal bore arranged, for example, in the center and along the longitudinal axis 10. This longitudinal bore allows the additional fluid water exiting from the first solenoid valve 2 to reach the combustion chamber of the internal combustion engine. Thus, the first solenoid valve 2 is able to inject a metered quantity of an additional fluid, such as water, into the combustion chamber, regardless of the operation of the second solenoid valve 3.

An additional fluid is introduced into an additional fluid chamber 12 inside the injector 1 via the first connection 4. This chamber 12 is closed by the first nozzle needle 7. Via the second connection 5, a pressurized fuel is introduced into a fuel chamber 13 of the injector 1, which is closed by the second nozzle needle 9. Such chambers 12 and 13 for storing fuel or an additional fluid offer the advantage of compensating for pressure fluctuations which can occur during ongoing operation of the internal combustion engine.

Activating the second solenoid 8 of the second solenoid valve 3 opens the second nozzle needle 9, enabling fuel to be injected from the fuel chamber 13 of the injector 1 through the nozzle 14 at the tip of the second nozzle needle 9 into the combustion chamber of the internal combustion engine.

Without this electrical control, the for example conical tip of the second nozzle needle 9 of the second solenoid valve 3 is pressed by a second spring 15 against a likewise conically terminated fuel outlet nozzle 14 of the injector 1 and is thus closed.

In this exemplary embodiment of the invention, the first nozzle needle 7 moves away from the combustion chamber in order to open the opening for injecting an additional fluid, as indicated in FIG. 1 by the arrow in the first nozzle needle 7.

In this exemplary embodiment of the invention, the second nozzle needle 9 must move towards the combustion chamber in order to open the opening for injecting fuel into the combustion chamber of the internal combustion engine, as indicated in FIG. 1 by the arrow in the second nozzle needle 9.

The housing of the injector 1 can, for example, be constructed in three parts from three housing parts and, when assembled, form a cylindrical body with a base body 18. To affix the three housing parts of the injector to one another, a first union nut 16 and a second union nut 17 are arranged at the ends of the injector 1. Such a construction enables a simple assembly of the injector 1 and provides good mechanical stability.

For example, a positioning bolt 19 ensures that the fuel bores in the lower and middle housing part are axially aligned with one another when the injector 1 is assembled.

As is known in the art, the first spring 11 and the second spring 15 each produce a corresponding restoring force, which returns the first nozzle needle 7 and the second nozzle needle 9 to their respective starting positions, after the magnetic forces of the first magnetic coil 6 and the second magnetic coil 8 have been removed. A stuffing box 20, on which the first spring 11 is supported, is provided for suitably positioning the first spring 11 so that it can fulfill its function. This is necessary because this first spring 11 is arranged in an inflow channel between the first connection 4 and the first nozzle needle 7 or the additional fluid chamber 12.

To ensure a simple assembly of the injector 1, the lower, second nozzle needle 9 is composed of several parts. For this purpose, the second nozzle needle 9 may, for example, have a thread onto which an anchor can be screwed. The position of this anchor can be secured, for example, with a lock nut or an alternative fastening element.

In the region of the first solenoid valve 2, the injector 1 has a first holder 21 which receives the first solenoid 6 and a functionally associated first iron ring 22. The holder 21 also has an electrical connection for connecting the first magnetic coil 6, for example, to a control device (not shown).

In the region of the second solenoid valve 3, the injector 1 has a second holder 23 which receives the second solenoid 8 and a functionally associated second iron ring 24. The second holder 23 also has an electrical connection for connecting the second magnetic coil 8 to the control device.

Corresponding seals 25 and 26 are provided to seal the supply lines (not shown) for the first connection 4 and for the second connection 5.

The injector 1 according to the invention enables a fuel and an additional fluid, such as water, to be injected independently of one another. To control the injector 1, a control unit and conventional systems for supplying a fuel or an additional fluid may be provided. As is customary, the fuel and the additional fluid may be supplied to the injector 1 under pressure.

Figure 2:
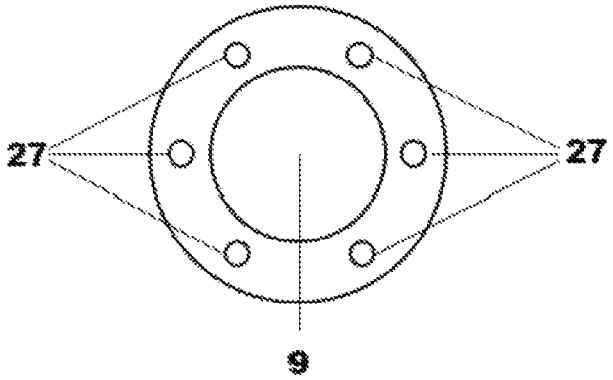
FIG. 2: a view of several outlet openings in a nozzle needle of the injector according to the invention, FIG. 3 an illustration of several injection phases that can be handled by the injector according to the invention in an internal combustion engine with a preceding water injection, and FIGS. 4*a* to 4*d* illustrations of different phases of the operation of an internal combustion engine with a preceding water injection into a combustion chamber.

FIG. 2 shows a view of several outlet openings 27 in the second nozzle needle 9 of the injector 1 according to the invention. The second nozzle needle 9, which has a centrally arranged longitudinal bore, can be designed with a fully continuous longitudinal bore.

In an alternative embodiment, the end of the second nozzle needle 9 pointing into the combustion chamber of an internal combustion engine may not be designed to terminate with a central longitudinal bore. For an improved spatial distribution of an additionally injected fluid, the end of the second nozzle needle 9 may have several outlet openings 29 which are not arranged in the area of the longitudinal axis 10.

These outlet openings 29 may have a smaller diameter than the longitudinal bore and may be arranged, for example, on a circle around the longitudinal axis 10.

In the illustration of FIG. 2, the longitudinal bore is designed as a countersunk bore that is connected to six outlet openings 29. These six outlet openings 29 may be arranged at the end of the second nozzle needle 9 in such a way that their respective longitudinal axes intersect with the longitudinal axis 10 of the second nozzle needle 9. The respective longitudinal axes of the six outlet openings 29 are thus arranged at an angle with respect to the longitudinal axis 10, which may for example be between 15° and 55°. The design of the end of the second nozzle needle 9 is shown here as an example and does not represent a limitation of this design.

Figure 3:
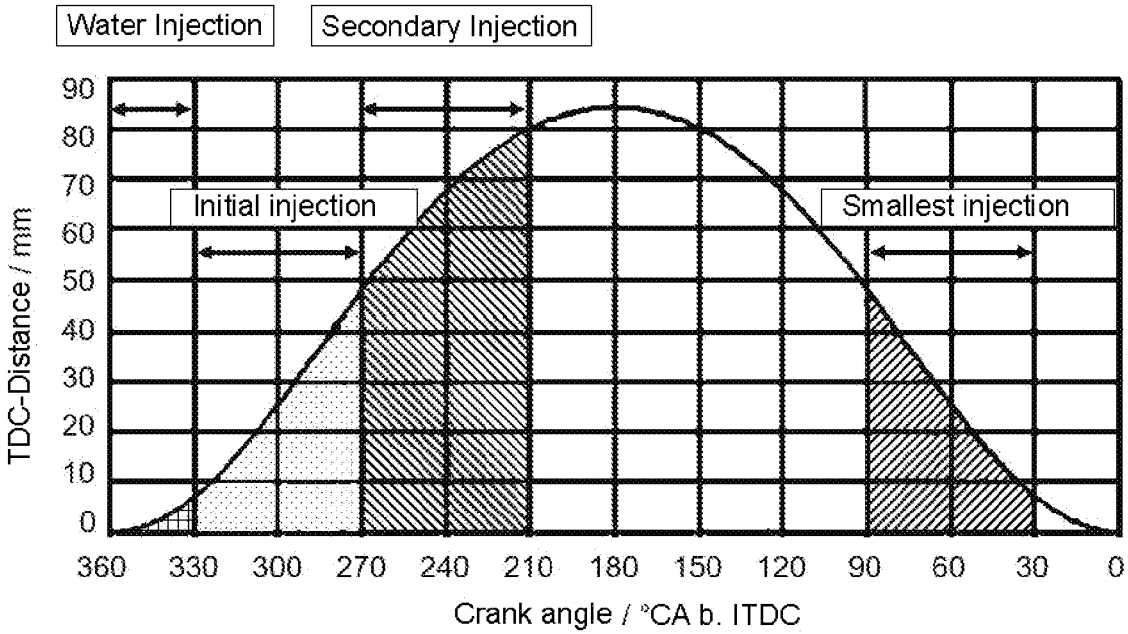

FIG. 3 shows a diagram of several injection phases that can be handled by means of the injector 1 according to the invention in an internal combustion engine with an upstream water injection.

The diagram shows as an example a curve depicting the distance between the piston and top dead center as a function of the angle of the crankshaft.

As shown, for example, an additional fluid, such as water, is injected into a combustion chamber in a range between 360° and 330°, which can be implemented by the first solenoid valve 2 of the injector 1 according to the invention.

Also shown is a first injection of a fuel in the range between 330° and 270° and a second injection in a range between 270° and 210°, which can be implemented by the second solenoid valve 3 of the injector 1 according to the invention.

This example only serves to illustrate the effort involved in determining optimal parameter combinations, wherein three injection times with their respective mass proportions and pressures have to be coordinated with one another, as well as the possible uses of the injector 1 according to the invention.

The injector according to the invention may advantageously also be used to generate a locally different composition of the fuel-air mixture, i.e. a charge stratification, in the combustion chamber of the internal combustion engine. The article "Upstream fuel quantity with stratified diesel-water injection", MTZ 01/2007, year 68, Vieweg Verlag, is hereby representative as a source describing the state of the art.

Figure 4A:
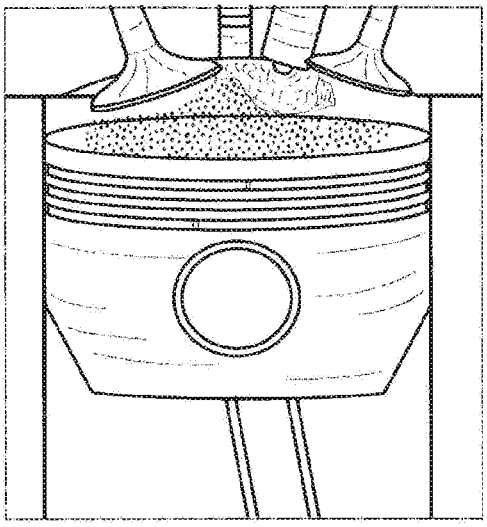

In an early intake phase, a water injection can precede the fuel injection, as is shown in FIG. 4*a*. This water injection is performed with the first solenoid valve 2. An insulating vapor layer is formed as a result of the evaporation of the water injected into the hot combustion chamber of the internal combustion engine.

Figure 4B:
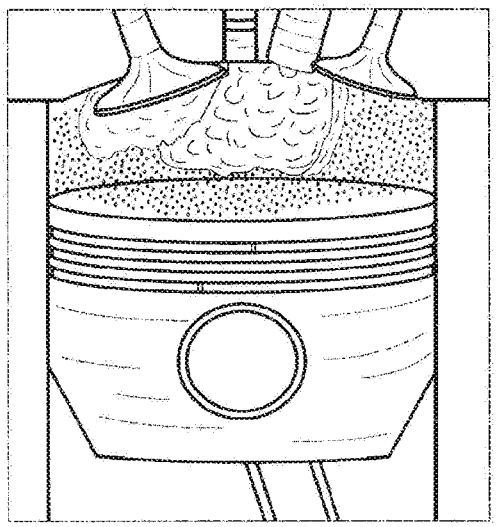

The fuel is then injected into this insulating vapor layer with the second solenoid valve 3. The resulting fuel-air mixture is now surrounded or enveloped by the insulating vapor layer. The formation of the desired vapor layer around the fuel-air mixture in an intake phase is shown in FIG. 4*b*.

Figure 4C:
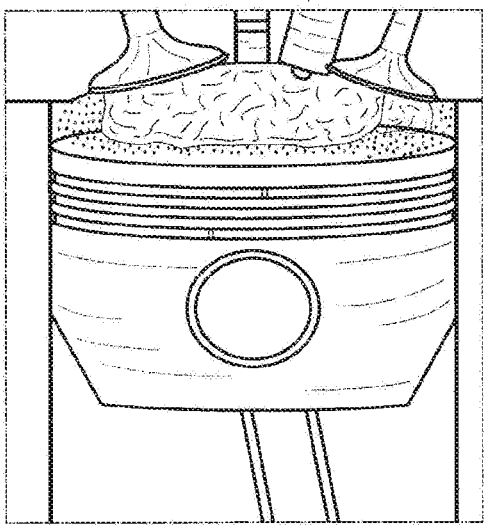

In the expansion phase following this intake phase, the insulating vapor layer keeps enveloping the fuel-air mixture, as shown in FIG. 4*c*.

Figure 4D:
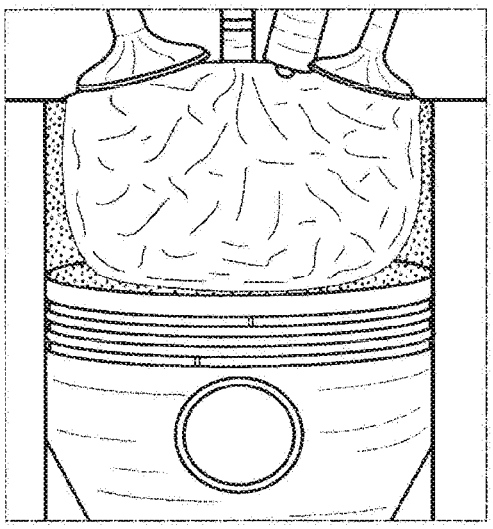

At the time of the combustion of the fuel-air mixture in the combustion chamber of the internal combustion engine, the insulating vapor layer forms an insulating layer towards the cylinder wall and the piston. This combustion process is shown in FIG. 4*d*. The formation of this insulation layer reduces the wall heat losses of the cylinder walls.

LIST OF REFERENCE SYMBOLS

1 injector
2 first solenoid valve
3 second solenoid valve
4 first connection (additional fluid/water)
5 second connection (fuel)
6 first solenoid
7 first nozzle needle
8 second solenoid
9 second nozzle needle
10 longitudinal axis
11 first spring
12 additional fluid chamber (water chamber)
13 fuel chamber
14 nozzle
15 second spring
16 first union nut
17 second union nut
18 base body
19 positioning bolt
20 stuffing box
21 first holder
22 first iron ring
23 second holder
24 second iron ring
25 first seal
26 second seal
27 outlet opening

The invention claimed is:

1. An injector (1) for injecting fuel and an additional fluid into a combustion chamber of an internal combustion engine, the injector (1) comprising: a first solenoid valve (2) with a first nozzle needle (7) for delivery of an additional fluid, and a second solenoid valve (3) with a second nozzle needle (9) for delivery of a fuel arranged in the injector (1), that the first nozzle needle (7) of the first solenoid valve (2) and the second nozzle needle (9) of the second solenoid valve (3) are arranged on a longitudinal axis (10) of the injector (1) one behind the other; the second nozzle needle (9) of the second solenoid valve (3) is arranged between the first nozzle needle (7) and the combustion chamber of the internal combustion engine on the longitudinal axis (10) of the injector (1); wherein injection into the combustion chamber of the additional fluid precedes that of the fuel.

2. The injector (1) according to claim 1, wherein the second nozzle needle (9) has a longitudinal bore.

3. The injector (1) according to claim 2, wherein the second nozzle needle (9) has a plurality of outlet openings (27) connected to the longitudinal bore.

4. The injector (1) according to claim 1, wherein the injector has a three-part housing which is secured with a first union nut (16) and a second union nut (17).

5. The injector (1) according to claim 1, further comprising a first holder (21) with a first magnetic coil (6) and a second holder (23) with a second magnetic coil (8) are arranged on the injector (1).

6. A method for injecting fuel and an additional fluid into a combustion chamber of an internal combustion engine using an injector (1), comprising the steps of:

providing a first solenoid valve (2) with a first nozzle needle (7) for injecting an additional fluid into the combustion chamber, and providing a second solenoid valve (3) with a second nozzle needle (9) in the injector (1) for injecting a fuel into the combustion chamber, wherein the first nozzle needle (7) of the first solenoid valve (2) and the second nozzle needle (9) of the second solenoid valve (3) are arranged one behind the other on a longitudinal axis (10) of the injector (1), and the nozzle needles (7, 9) are controlled independently of one another;

wherein the first solenoid valve (2) injects a metered quantity of the additional fluid and the second solenoid valve (3) injects a metered quantity of the fuel into the combustion chamber of the internal combustion engine; wherein injection into the combustion chamber of the additional fluid metered by the first solenoid valve (2) precedes injection of the fuel metered by the second solenoid valve (3).

7. The method according to claim 6, wherein the additional fluid metered by the first solenoid valve (2) is injected into the combustion chamber guided through a longitudinal bore provided in the second nozzle needle (9).

8. The method according to claim 7, wherein the additional fluid injected into the combustion chamber is distributed by several outlet openings (27) provided at an end of the second nozzle needle (9) and connected to the longitudinal bore.

* * * * *